US010650843B2

(12) United States Patent
Goshen et al.

(10) Patent No.: US 10,650,843 B2
(45) Date of Patent: May 12, 2020

(54) SYSTEM AND METHOD FOR PROCESSING SOUND BEAMS ASSOCIATED WITH VISUAL ELEMENTS

(71) Applicant: InSoundz Ltd., Tel Aviv (IL)

(72) Inventors: Tomer Goshen, Tel Aviv (IL); Emil Winebrand, Petach Tikva (IL); Tzahi Zilbershtein, Holon (IL)

(73) Assignee: InSoundz Ltd., Tel Aviv (IL)

( * ) Notice: Subject to any disclaimer, the term of this patent is extended or adjusted under 35 U.S.C. 154(b) by 0 days.

(21) Appl. No.: 16/404,193

(22) Filed: May 6, 2019

(65) Prior Publication Data

US 2019/0348061 A1 Nov. 14, 2019

Related U.S. Application Data

(60) Provisional application No. 62/668,921, filed on May 9, 2018.

(51) Int. Cl.
*G10L 25/03* (2013.01)
*H04R 1/40* (2006.01)

(52) U.S. Cl.
CPC ..... *G10L 25/03* (2013.01); *H04R 1/406* (2013.01)

(58) Field of Classification Search
CPC ..... G10L 25/03; H04R 1/406
See application file for complete search history.

(56) References Cited

U.S. PATENT DOCUMENTS

2010/0306193 A1* 12/2010 Pereira ..... G06K 9/00758 707/728

* cited by examiner

*Primary Examiner* — Mark Fischer
(74) *Attorney, Agent, or Firm* — M&B IP Analysts, LLC

(57) ABSTRACT

A system and method for a method for processing sound beams associated with visual elements, including: analyzing at least one received multimedia data element (MMDE) to identify audio features and visual elements within the MMDE; extracting at least one audio feature and at least one visual element from the MMDE; generating at least one sound signal from the MMDE based on the audio features; associating the at least one sound signal with at least one of the visual elements; and tagging each associated sound signals and visual element as an event.

13 Claims, 3 Drawing Sheets

SYSTEM AND METHOD FOR PROCESSING SOUND BEAMS ASSOCIATED WITH VISUAL ELEMENTS

CROSS-REFERENCE TO RELATED APPLICATIONS

This application claims the benefit of U.S. Provisional Application No. 62/668,921 filed on May 9, 2018, the contents of which are hereby incorporated by reference.

TECHNICAL FIELD

The present disclosure relates generally to sound capturing systems and, more specifically, to systems for capturing sounds using a plurality of microphones and a visual capturing device.

BACKGROUND

Audio is an integral part of multimedia content, whether viewed on a television, a personal computing device, a projector, or any other of a variety of viewing means. The importance of audio becomes increasingly significant when the content includes multiple sub-events occurring concurrently. For example, while viewing a sporting event, many viewers appreciate the ability to listen to conversations occurring between players, instructions given by a coach, exchanges of words between a player and an umpire, and similar verbal communications, simultaneously with the audio of the event itself.

The obstacle with providing such simultaneous concurrent audio content is that currently available sound capturing devices, i.e., microphones, are unable to practically adjust to dynamic and intensive environments, such as, e.g., a sporting event. Many current audio systems struggle to track a single player or coach as that person moves through space, and falls short of adequately tracking multiple concurrent audio events.

Commonly, a large microphone boom is used to move the microphone around in an attempt to capture the desired sound. This issue is becoming significantly more notable due to the advent of high-definition (HD) television that provides high-quality images on the screen with disproportionately low sound quality.

It would therefore be advantageous to provide a solution that would overcome the challenges noted above.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "certain embodiments" may be used herein to refer to a single embodiment or multiple embodiments of the disclosure.

Certain embodiments disclosed herein include a method for processing sound beams associated with visual elements, including: analyzing at least one received multimedia data element (MMDE) to identify audio features and visual elements within the MMDE; extracting at least one audio feature and at least one visual element from the MMDE; generating at least one sound signal from the MMDE based on the audio features; associating the at least one sound signal with at least one of the visual elements; and tagging each associated sound signals and visual element as an event.

Certain embodiments disclosed herein also include a non-transitory computer readable medium having stored thereon instructions for causing a processing circuitry to perform a process, the process including: analyzing at least one received multimedia data element (MMDE) to identify audio features and visual elements within the MMDE; extracting at least one audio feature and at least one visual element from the MMDE; generating at least one sound signal from the MMDE based on the audio features; associating the at least one sound signal with at least one of the visual elements; and tagging each associated sound signals and visual element as an event.

Certain embodiments disclosed herein also include a system for processing sound beams associated with visual elements, including: a processing circuitry; and a memory, the memory containing instructions that, when executed by the processing circuitry, configure the system to: analyze at least one received multimedia data element (MMDE) to identify audio features and visual elements within the MMDE; extract at least one audio feature and at least one visual element from the MMDE; generate at least one sound signal from the MMDE based on the audio features; associate the at least one sound signal with at least one of the visual elements; and tag each associated sound signals and visual element as an event.

BRIEF DESCRIPTION OF THE DRAWINGS

The subject matter disclosed herein is particularly pointed out and distinctly claimed in the claims at the conclusion of the specification. The foregoing and other objects, features, and advantages of the disclosed embodiments will be apparent from the following detailed description taken in conjunction with the accompanying drawings.

DETAILED DESCRIPTION

Figure 1:
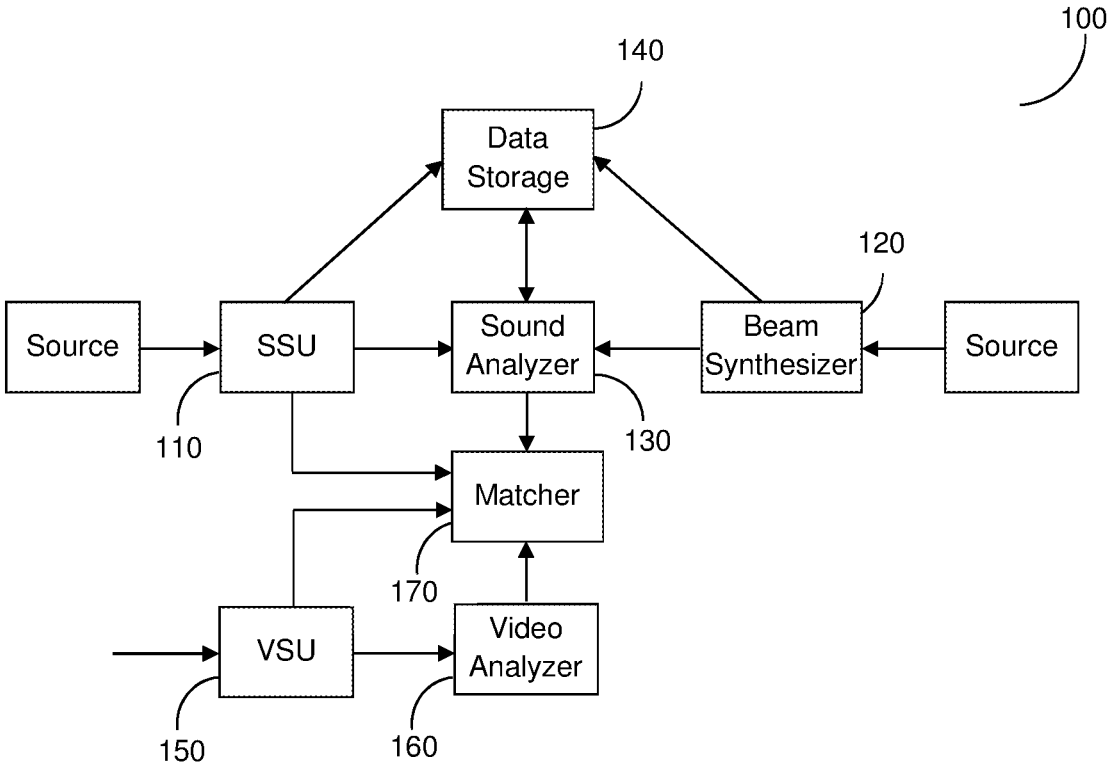
FIG. 1 is a block diagram of a sound processing system according to an embodiment.

It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

The various disclosed embodiments include a method and system for processing sound beams associated with visual elements. A system is disclosed which is configured to capture audio in the confinement of a predetermined sound beam. In an exemplary embodiment, the sound processing system includes a sound sensing unit including a plurality of microphones; a video sensing unit comprises one or more image capturing devices; a video analyzer connected to the video sensing unit; a sound analyzer connected to the sound sensing unit and to a beam synthesizer, wherein upon receiving at least one multimedia data element comprising a plurality of events, the at least one multimedia data element is analyzed by the sound analyzer and the video analyzer; a plurality of visual elements are extracted from the at least one multimedia data element; a plurality of audio features are extracted from the at least one multimedia data element, wherein the audio features are at least one of: phonemes, sound effects, a combination thereof; a plurality of sound signals are generated from the at least one multimedia data element; and, each of the plurality of sound signals from the at least one multimedia data element are associated with one or more of the plurality of visual elements respective of the one or more audio features.

FIG. 1 is a block diagram of a sound processing system 100 according to an embodiment. The sound processing system 100 includes a sound sensing unit (SSU) 110, a sound analyzer 130, a video sensing unit (VSU) 150, and video analyzer 160, and a matcher 170. In an embodiment, the sound processing system 100 further include a beam synthesizer 120.

The SSU 110 is configured to identify a plurality of sound signals from a multimedia data element, e.g., a live video stream, and may include capture devices, such as one or more microphones. A multimedia data element may include a video stream, a video file, broadcast content, augmented and virtual reality content, and the like. The multimedia data element may be retrieved from a variety of sources, including an internet connection, a broadcast signal, a digital file transmission and so on.

A sound beam defines a directional angular dependence of the gain of a received spatial sound wave. A beam synthesizer 120 is configured to receive sound beam metadata from a sound source. In an embodiment, the sound source is the multimedia data element, e.g., a live video stream. The sound beam metadata from the beam synthesizer 120 and the plurality of sound signals received by the SSU 110 are transmitted to the sound analyzer 130 that is configured to extract a plurality of audio features from the at least one multimedia data element, e.g., obtained from the SSU 110, wherein the audio features are at least one of: phonemes, sound effects, or a combination thereof. The metadata from the sound beams received by the beam synthesizer may be used to identify additional qualities of the sound wave, e.g., the location of origin of the sound wave within a scene, the sound direction of the sound wave, and the like.

In one embodiment, the sound processing system 100 further includes a storage in the form of a data storage unit 140 or a database (not shown) for storing, for example, one or more definitions of audio features, metadata, information from filters, raw data (e.g., sound signals), or other information captured by the sound sensing unit 110 or the beam synthesizer 120. The filters may include circuits working in the audio frequency range used to process the raw data captured by the sound sensing unit 110. The filters may be preconfigured or may be dynamically adjusted with respect to the received metadata. In various embodiments, one or more of the sound sensing unit 110, the sound analyzer 130, and the beam synthesizer 120 may be coupled to the data storage unit 140. In another embodiment, the sound processing system 100 may further include a control unit (not shown) connected to the beam synthesizer unit 120. The control unit may further include a user interface that allows a user to capture or manipulate any sound beam.

The sound processing system 100 further includes the video sensing unit (VSU) 150. The VSU 150 includes one or more multimedia capturing devices, such as, for example, video cameras. At least one multimedia data element (MMDE) captured by the VSU 150 is transferred to the video analyzer 160. The video analyzer 160 is configured to analyze the MMDEs using one or more computer vision techniques, where the analysis may include identifying visual elements within the MMDE. Based on the analysis, a plurality of the identified visual elements are extracted from the at least one multimedia data element.

A plurality of sound signals are generated from the at least one MMDE. A matcher 170 is then configured to associate each of the plurality of sound signals from the at least one MMDE with one or more of the plurality of visual elements respective of the one or more audio features. Each such association is then tagged as an event. The events may then be sent for storage in the data storage unit 140. The matcher 170 may be directly or indirectly coupled to the SSU 110 or to the VSU 150. According to an embodiment, the matcher is further 170 configured to receive additional raw data from the SSU 110. The additional raw data may include, for example, metadata associated with the MMDE, e.g., location parameters, time stamps, length of audio or video stream, and the like.

In an embodiment, beamforming techniques, sound signal filters, and weighted factors are employed as part of the analysis, and are described further in the U.S. Pat. No. 9,788,108, assigned to the common assignee, which is hereby incorporated by reference.

Thereafter the matcher 170 is configured to allocate clean sound signals per event. The clean sound signal may be provided as an output for further processing or sent for storage in a database. Thus, each event includes visual elements associated with audio features, and clean sound signals associated with the event.

Figure 2:
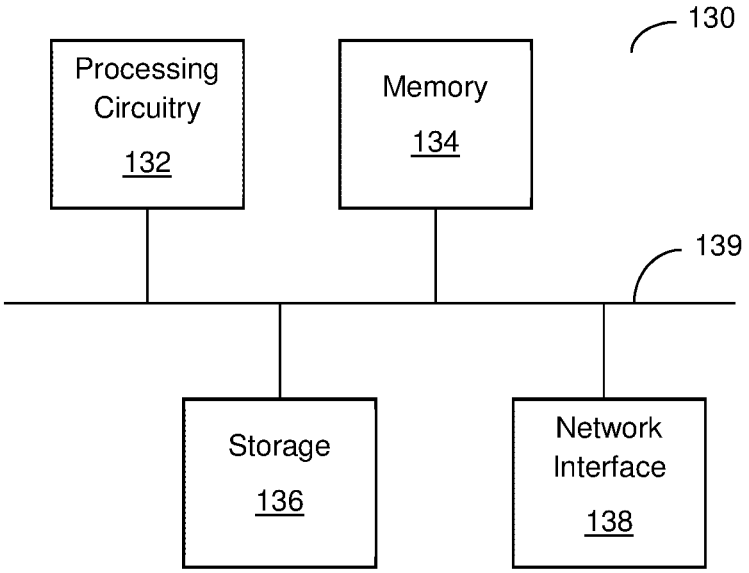
FIG. 2 is an example block diagram of the sound analyzer according to an embodiment.

FIG. 2 is an example block diagram of the sound analyzer 130 according to an embodiment. The sound analyzer 130 includes a processing circuitry 132 coupled to a memory 134, a storage 136, and a network interface 138. In an embodiment, the components of the sound analyzer 130 may be communicatively connected via a bus 139.

The processing circuitry 132 may be realized as one or more hardware logic components and circuits. For example, and without limitation, illustrative types of hardware logic components that can be used include field programmable gate arrays (FPGAs), application-specific integrated circuits (ASICs), application-specific standard products (ASSPs), system-on-a-chip systems (SOCs), general-purpose microprocessors, microcontrollers, digital signal processors (DSPs), and the like, or any other hardware logic components that can perform calculations or other manipulations of information.

In another embodiment, the memory 134 is configured to store software. Software shall be construed broadly to mean any type of instructions, whether referred to as software, firmware, middleware, microcode, hardware description language, or otherwise. Instructions may include code (e.g., in source code format, binary code format, executable code format, or any other suitable format of code). The instructions cause the processing circuitry 132 to perform the sound analysis described herein.

The storage 136 may be magnetic storage, optical storage, and the like, and may be realized, for example, as flash memory or other memory technology, hard-drives, SSD, or any other medium which can be used to store the desired information. The storage 136 may store one or more sound signals, one or more grids associated with an area, interest points and the like.

The network interface 138 is configured to allow the sound analyzer 130 to communicate with the sound sensor 110, the data storage 140, and the beam synthesizer 120. The network interface 138 may include, but is not limited to, a wired interface (e.g., an Ethernet port) or a wireless port (e.g., an 802.11 compliant WiFi card) configured to connect to a network (not shown).

Figure 3:
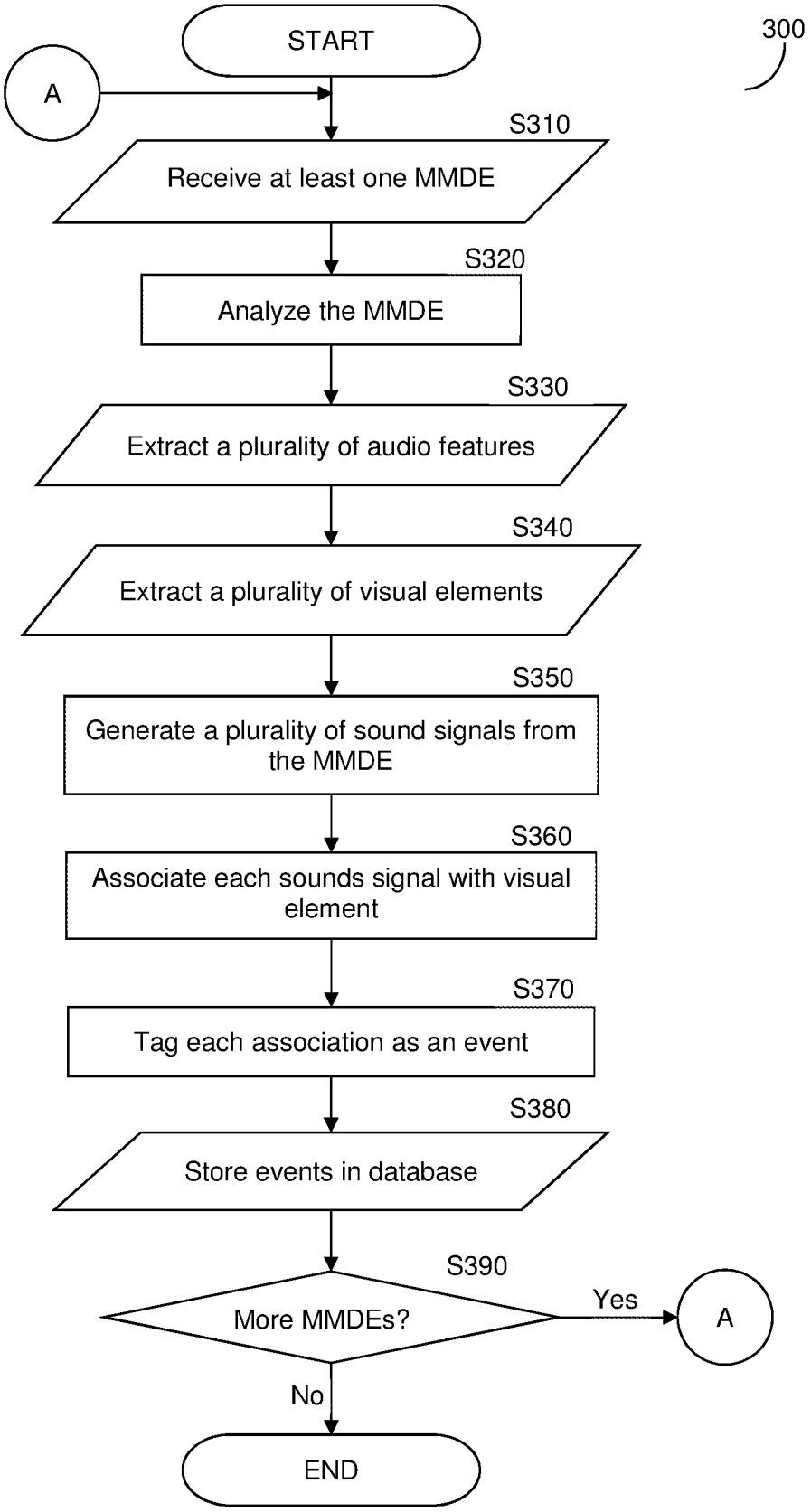
FIG. 3 is an exemplary and non-limiting flowchart illustrating a method for processing sound signals associated with a multimedia data element according to an embodiment.

FIG. 3 is an exemplary and non-limiting flowchart 200 illustrating a method for processing sound signals associated with a multimedia data element according to an embodiment. In an embodiment, the sound signals may be captured by the sound processing system 100.

At S310, at least one multimedia data element (MMDE) is received. The MMDE may be, for example, an image, a graphic, a video stream, a video clip, an audio stream, an audio clip, a video frame, a photograph, and an image of signals (e.g., spectrograms, phasograms, scalograms, and the like.), or combinations thereof and portions thereof. The MMDE may be received from a server, a broadcast receiver, a database, and the like.

At S320, the at least one MMDE is analyzed. The analysis is performed by the sound analyzer 130 and the video analyzer 160 as further described hereinabove with respect of FIG. 1, and may include identifying sound and visual elements within the MMDE.

At S330, based on the analysis, a plurality of audio features are extracted from the at least one MMDE. Audio features may include at least one of: phonemes, sound effects, or a combination thereof. At S340, based on the analysis, a plurality of visual elements are extracted from the at least one MMDE. Visual elements may include a person, an animal, various subjects within a video frame, and the like.

At S350, a plurality of sound signals are generated from the at least one MMDE. At 360, each visual element is associated with at least one sound signal. Thus, a sound signal is paired with an associated visual element, such as a person within a video frame.

At S370, each association between a visual element and a sound signal is tagged as an event. At S380, the events are stored in a database, e.g., for future reference. At 380, the system checks whether additional MMDEs are to be received and, if so, execution continues with S310; otherwise, execution terminates.

The various embodiments disclosed herein can be implemented as hardware, firmware, software, or any combination thereof. Moreover, the software is preferably implemented as an application program tangibly embodied on a program storage unit or computer readable medium consisting of parts, or of certain devices and/or a combination of devices. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such a computer or processor is explicitly shown. In addition, various other peripheral units may be connected to the computer platform such as an additional data storage unit and a printing unit. Furthermore, a non-transitory computer readable medium is any computer readable medium except for a transitory propagating signal.

As used herein, the phrase "at least one of" followed by a listing of items means that any of the listed items can be utilized individually, or any combination of two or more of the listed items can be utilized. For example, if a system is described as including "at least one of A, B, and C," the system can include A alone; B alone; C alone; A and B in combination; B and C in combination; A and C in combination; or A, B, and C in combination.

All examples and conditional language recited herein are intended for pedagogical purposes to aid the reader in understanding the principles of the disclosed embodiment and the concepts contributed by the inventor to furthering the art, and are to be construed as being without limitation to such specifically recited examples and conditions. Moreover, all statements herein reciting principles, aspects, and embodiments of the disclosed embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. A method for processing sound beams associated with visual elements, comprising:

analyzing at least one received multimedia data element (MMDE) to identify audio features and visual elements within the MMDE;

extracting at least one audio feature and at least one visual element from the MMDE;

generating at least one sound signal from the MMDE based on the audio features;

associating the at least one sound signal with at least one of the visual elements; and tagging each associated sound signals and visual element as an event.

2. The method of claim 1, wherein the audio features includes at least one of: phonemes and sound effects.

3. The method of claim 1, wherein the audio features of the MMDE is analyzed and extracting using a beam synthesizer.

4. The method of claim 3, wherein the beam synthesizer is used to identify additional data related to the MMDE, including at least one of: the location of origin of the sound wave within a scene and the sound direction of the sound wave.

5. The method of claim 1, further comprising:

allocating clean sound signals to each of the tagged events.

6. The method of claim 1, wherein the event is stored in a database.

7. A non-transitory computer readable medium having stored thereon instructions for causing a processing circuitry to perform a process, the process comprising:

analyzing at least one received multimedia data element (MMDE) to identify audio features and visual elements within the MMDE;

extracting at least one audio feature and at least one visual element from the MMDE;

generating at least one sound signal from the MMDE based on the audio features;

associating the at least one sound signal with at least one of the visual elements; and tagging each associated sound signals and visual element as an event.

8. A system for processing sound beams associated with visual elements, comprising:

a processing circuitry; and a memory, the memory containing instructions that, when executed by the processing circuitry, configure the system to:

analyze at least one received multimedia data element (MMDE) to identify audio features and visual elements within the MMDE;

extract at least one audio feature and at least one visual element from the MMDE;

generate at least one sound signal from the MMDE based on the audio features;

associate the at least one sound signal with at least one of the visual elements; and tag each associated sound signals and visual element as an event.

9. The system of claim 8, wherein the audio features includes at least one of: phonemes and sound effects.

10. The system of claim 8, wherein the audio features of the MMDE is analyzed and extracting using a beam synthesizer.

11. The system of claim 10, wherein the beam synthesizer is used to identify additional data related to the MMDE, including at least one of: the location of origin of the sound wave within a scene and the sound direction of the sound wave.

12. The system of claim 8, wherein the system if further configured to:

allocating clean sound signals to each of the tagged events.

13. The system of claim 8, wherein the event is stored in a database.

* * * * *